US006642443B2

(12) United States Patent
Okada et al.

(10) Patent No.: US 6,642,443 B2
(45) Date of Patent: Nov. 4, 2003

(54) WOODWIND INSTRUMENT WITH KEY MECHANISM PERFECTLY CLOSING HOLES

(75) Inventors: Shigeru Okada, Shizuoka (JP); Jun Shibamiya, Shizuoka (JP)

(73) Assignee: Yamaha Corporation (JP)

( * ) Notice: Subject to any disclaimer, the term of this patent is extended or adjusted under 35 U.S.C. 154(b) by 35 days.

(21) Appl. No.: 10/205,420

(22) Filed: Jul. 26, 2002

(65) Prior Publication Data

US 2003/0029300 A1 Feb. 13, 2003

(30) Foreign Application Priority Data

Jul. 26, 2001 (JP) ..... 2001-226065

(51) Int. Cl.[7] ..... G10D 7/00
(52) U.S. Cl. ..... 84/380 R
(58) Field of Search ..... 84/380 R, 385 P, 84/385 A, 330

(56) References Cited

U.S. PATENT DOCUMENTS 4,114,500 A * 9/1978 Norbeck ..... 84/385 P
4,798,122 A * 1/1989 Gisler et al. ..... 84/385 P
5,417,135 A * 5/1995 Straubinger ..... 84/385 P
6,344,604 B1 * 2/2002 Schmidt ..... 84/385 P

* cited by examiner

*Primary Examiner*—Kim Lockett
(74) *Attorney, Agent, or Firm*—Dickstein, Shapiro, Morin & Oshinsky, LLP.

(57) ABSTRACT

A woodwind instrument has a key mechanism provided on a tube, and a player selectively closes and opens holes formed in the tube through a fingering; the key mechanism includes keys corresponding to the holes, and each of the key has an automatic regulator for uniformly pressing a pad washer to a pad received in a pad cup so that, even if the pad cup is inaccurately fixed to a linkage of the key mechanism, the hole is surely closed with the pad.

17 Claims, 3 Drawing Sheets

WOODWIND INSTRUMENT WITH KEY MECHANISM PERFECTLY CLOSING HOLES

FIELD OF THE INVENTION

This invention relates to woodwind instrument and, more particularly, those types of woodwind instrument equipped with key mechanisms for closing holes formed in tubes.

DESCRIPTION OF THE RELATED ART

The woodwind instrument has a wide variety of family members such as, for example, flutes, recorders, clarinets, oboes, saxophones and bassoons. Although the word "woodwind" is a compound word produced from the words "wood" and "wind", the word "woodwind" does not imply the material of the wind instruments. The bassoons and clarinets are usually made of wood. However, the saxophones are made of metal. Several family members such as flutes are directly blown by players. On the other hand, players require reeds for other family members. The players blow the clarinets by means of reeds, by way of example. Although the players give rise to vibrations of air columns in different manners, they are the family members of the woodwind instrument. Nevertheless, all the family members of woodwind instrument have tubes formed with holes, and the players selectively open and close the holes for changing the pitch of notes emitted. The tubes of recorders are not so long that the players can selectively open and close the holes with their fingers. However, the flutes, saxophones, oboes and bassoons have the tubes formed with the holes, which are widely spaced from one another. The intervals are too long for the players to selectively open and close them with their fingers. For this reason, these family members require unique key mechanisms. The present invention appertains to those family members of the type having the key mechanisms.

A flute is, by way of example, broken down into a tube, which may be separable into plural parts, and a key mechanism. The tube is formed with a mouthpiece and holes. The mouthpiece is formed at one end portion of the tube, and the holes are arranged along the centerline of the tube toward the other end. The key mechanism includes plural keys, with which a player selectively opens and closes the holes for changing the pitch of tones.

FIG. 2 illustrates the prior art key 4 incorporated in the flute. The prior art key 4 is broken down into a pad 10, a pad cup 11 and a fastener 12. The pad cup 11 is formed of metal or alloy, and has a recess where the pad 10 is snugly received. The fastener 12 prohibits the pad 10 from being unintentionally separated from the pad cup 11. A tone hole chimney 5 encircles one of the holes 2 formed in the tube, and the upper edge 5*a* of the tone hole chimney 5 is rounded. The pad 10 is pressed to the rounded edge 5*a* for closing the hole 2.

The pad 10 is to be air-tight, adaptable and durable. While a player is playing on the flute, the moist breath passes through the tube, and vents through the hole 2, which the player keeps opened. The pads 10 are expected to confine the wet air in the tube. If the breath is leaked through the pads 10, the tones become unstable, and the player feels the pitches, loudness and timbre less controllable. In order hermetically to seal the breath in the tube, the pads 10 are expected to adapt themselves to the holes 2. Thus, the pads 10 are to be adaptable and airtight.

The pads 10 are exposed to the wet air during the practice and performance. Although the player wipes the condensate from the inner wall of the tube 1 after the practice, the condensate is liable to be left on the pads 10. The pads 10 are dried until the next practice/performance. Thus, the pads 10 are repeatedly exposed to the wet air and dried thereafter. Nevertheless, the pads 10 are expected to maintain the adaptability and the air-tightness. If the pads 10 lose the adaptability and air-tightness within a short time, the player frequently changes the pads 10 from the waste ones to new pieces. The exchange work is time-consuming, and players hate it. For this reason, the pads 10 are to be durable.

From those viewpoints, the pad 10 is designed to have a core 10*a*/15 and a sealing layer 10*b*. The core 10*a*/15 imparts the adaptability to the pad 10, and the sealing layer 10*b* makes the pad 10 airtight. A core layer 10*a* and a backing cardboard 15 as a whole constitute the core. The backing cardboard 15 is made of paper, and the core layer 10*a* is made of air-permeable material such as compression felt. The core layer 10*a* is laminated on the backing cardboard 15, and sealing layer 10*b* is fixed to the core layer 10*a* reverse to the backing cardboard 15. The sealing layer 10*b* is expected to hermetically seal the air column inside the tube. Skin and bladder are available for the sealing layer 10*b*. It is preferable to make the sealing layer 10*b* from sheepskin, calfskin and bladder of sheep and calf. The pad 10 is formed with a center hole. The center hole is increased in diameter from the core/sealing layers 10*a*/10*b* to the backing cardboards 15 so that a step takes place at the boundary between the backing cardboard 15 and the core layer 10*a*.

The pad cups 11 are formed from a sheet of metal/alloy through a drawing. Each of the pad cups 11 has a peripheral wall portion 11*a* so as to define the recess. The recess has an inner diameter substantially equal to the outer diameter of the pad 10 so that the pad 10 is snugly received in the recess. However, the recess has the depth greater than the thickness of the pad 10. A player directly depresses the pad cups 11 with his or her fingers, and pushes levers, which are connected through shafts to the other pad cups 11, with his or her thumb and fingers for closing the holes 2. When the player removes the force from the pad cups 11 or the levers, return springs make the pad cups 11 open.

The fastener 12 consists of a center nut 13, a bolt 14 and a circular plate 12*a*. The center nut 13 is brazed to the inner surface of the pad cup 11, and an internal thread is formed along the centerline of the center nut 13. The center nut 13 has an end surface 13*a* where the internal thread is open, and the end surface 13*a* is flat. The center nut 13 has a wide boss portion substantially equal in diameter to the hole formed in the backing cardboard 15, and the remaining portion is substantially equal in diameter to the hole passing through the core layer 10*a* and the sealing layer 10*b*. Thus, the center nut 13 is snugly received in the center hole of the pad 10.

The bolt 14 has a head portion 14*a* and a threaded stem portion 14*b*, and the threaded stem portion 14*b* projects from the reverse surface of the head portion 14*a*. The reverse surface of the head portion 14*a* is also flat.

The circular plate 12*a* has major surfaces, which are also flat, and is formed with a hole at the center area thereof. The hole in the circular plate 12*a* has an inner diameter greater than the outer diameter of the threaded stem portion 14*b* so that the threaded stem portion 14*b* loosely passes through the hole formed in the circular plate 12*a*. The circular plate 12*a* has an outer diameter less than the outer diameter of the pad 10 and, accordingly, the inner diameter of the recess.

The key 4 is assembled as follows. An assembling worker puts the pad 10 into the recess. The center nut 13 is inserted into the center hole of the pad 10, and the flat end surface 13*a* is inside the center hole. Subsequently, the assembling worker puts the circular plate 12*a* on the sealing layer 10*b*, and aligns the hole formed in the circular plate 12*a* with the hole formed in the center nut 13. The assembling worker inserts the threaded stem portion 14*b* into the center nut 13, and turns the bolt 14. The threaded step portion 14*b* is brought into threaded engagement with the center nut 13, and the bolt 14 is screwed into the center nut 13. The flat reverse surface of the head portion is brought into face-to-face contact with the flat major surface of the circular plate 12*a*, and the head portion 14*a* is pressed against the circular plate 12. The circular plate 12*a* in turn presses the pad 10 to the boss portion of the center nut 13. Thus, the pad 10 is fastened to the pad cup 11 by means of the fastener 12.

Assuming now that the pad cup 11 was mistakenly brazed to the arm, the center line of the column 13 is inclined with respect to the centerline of the tone hole chimney 5 by θ as shown in FIG. 2. If the pad 10 is fastened to the pad cup 11 without any regulation, the pad 10 is also inclined with respect to the centerline of the tone hole chimney 5. When a player depresses the key 4 to the tone hole chimney 5, the pad 10 is imperfectly brought into contact with the upper edge 5*a*, and clearance takes place between the pad 10 and the tone hole chimney 5. This results in leakage of the breath. For this reason, if the angle θ is not serious, the assembling worker tries to regulate the pad 10 to the appropriate position.

The assembling worker inserts an adjusting shim 18 between the backing cardboard 15 and the pad cup 11. The adjusting shim 18 is made of paper, and makes the pad 10 spaced from a certain area on the inner surface of the pad cup 11. If the pad 10 is appropriately regulated by means of the adjusting shim 18, the centerline of the tone hole chimney 5 is normal to the pad 10, and the pad 10 is brought into contact with the entire upper edge of the tone hole chimney 5. The pad 10 prevents the hole 2 from leakage of the breath. However, a problem is encountered in the prior art keys 4 in that the breath is still leaked through some holes 2 after the regulating work.

SUMMARY OF THE INVENTION

It is therefore an important object of the present invention to provide a woodwind instrument, a key mechanism of which perfectly close and open holes formed in a tube after a regulating work.

The present inventors investigated the problem inherent in the prior art key, and found that the circular plate 12*a* was strongly pressed against the certain portion of the pad 10 where the adjusting shim 18 had been inserted. A dent was formed in the certain portion, and gap 17 took place between the upper edge 5*a* and the pad 10 in the vicinity of the dent. The breath was leaked through the gap 17.

The present inventors reasoned from the structure of the prior art key 4 as follows. The center nut 13 was inclined with respect to the centerline of the tone hole chimney 5, and the pad 10 and circular plate 12*a* were perpendicular to the centerline of the tone hole chimney 5 under the condition that any force was not exerted on the circular plate 12*a*. Since the bolt 14 was screwed into the inclined center nut 13, the head portion 14*a* proceeds toward the circular plate 12*a* along the inclined centerline of the center nut 13. The flat reverse surface of the head portion 14*a* was partially brought into contact with the certain area in the flat surface of the circular plate 12*a*. The head portion 14*a* exerted the force on the certain area, and caused the circular plate 12*a* to be inclined with respect to the centerline of the tone hole chimney 5. This resulted in the face-to-face contact between the flat reverse surface of the head portion 14*a* and the flat surface of the circular plate 12*a*. Since the head portion 14*a* uniformly exerted the force on the flat surface of the circular plate 12*a*, the circular plate 12*a* was forced to move along the inclined centerline of the center nut 13. Although the pad 10 resisted against the circular plate 12*a*, the sealing/core layers 10*b*/10*a* was deformable so that the circular plate 12*a* made the dent in the pad 10. The present inventors concluded that the dent and, accordingly, the clearance were resulted from the circular plate 12*a*, which changed the attitude when the head portion 14*a* was brought into contact therewith.

To accomplish the object, the present invention proposes automatically to regulate a pad washer to be in parallel to a pad while a bot is being screwed into a center nut.

In accordance with one aspect of the present invention, there is provided a woodwind instrument for generating tones through a vibrating column of air comprising a tube having an inner space where the vibrating column of air takes place and plural holes connecting the inner space to the atmosphere and a key mechanism including a linkage fixed to the tube and plural keys supported by the linkage over the plural holes and changed between respective open positions at which the holes are opened and respective closing positions at which the holes are closed, and each of the keys has a pad cup connected to the linkage and formed with a recess, a deformable pad received in the recess and held in contact with a periphery of the tube defining associated one of the holes at the closing position, a adjusting shim inserted between the pad cup and the deformable pad, if necessary, in order to cause the deformable pad to be held in contact with the entire periphery of the tube defining the associated one of the holes at the closing position, a fastener connected to the pad cup and exerting force on the pad for pressing the deformable pad and the adjusting shim, if any, to the pad cup and an automatic regulator provided in association with the fastener and causing the force to be substantially uniform over a contact surface between the fastener and the deformable pad.

BRIEF DESCRIPTION OF THE DRAWINGS

The features and advantages of the woodwind instrument will be more clearly understood from the following description taken in conjunction with the accompanying drawings, in which.

DESCRIPTION OF THE PREFERRED EMBODIMENT

Figure 1:
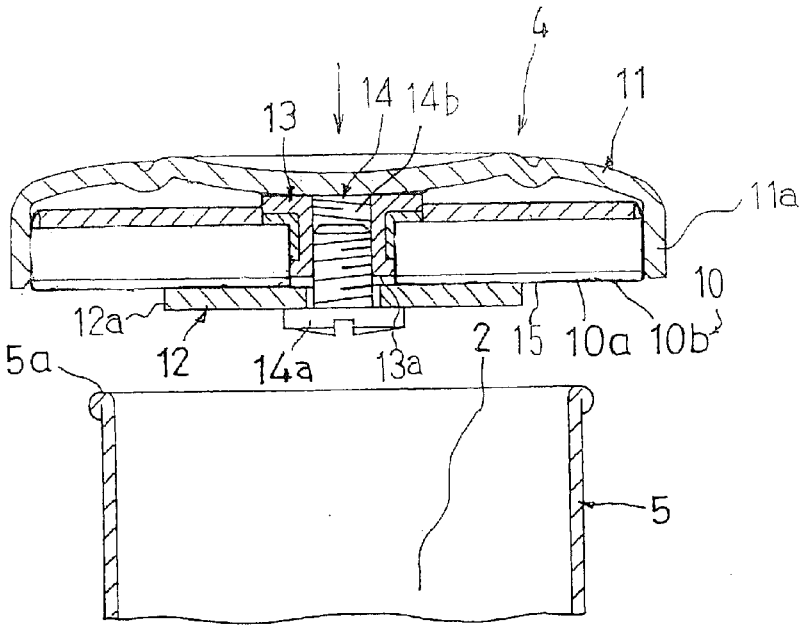
Fig. 1 PRIOR ART
FIG. 1 is a cross sectional view showing the structure of the key incorporated in the prior art flute.
Figure 2:
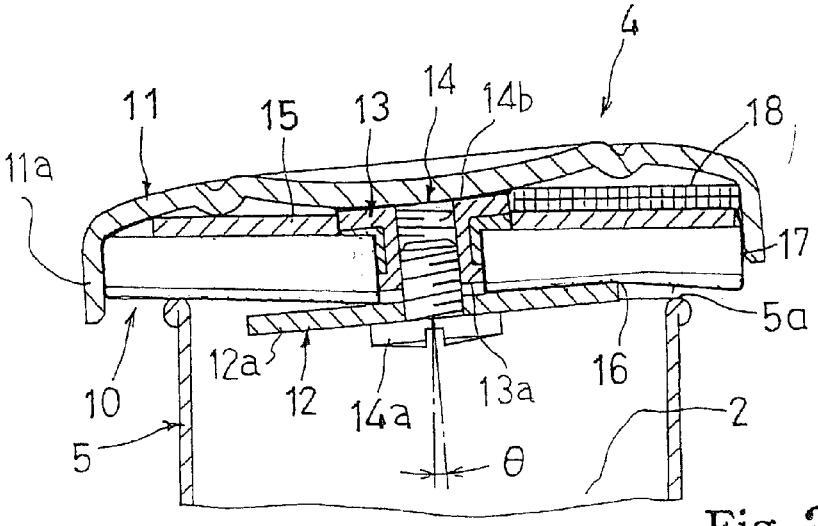
Fig. 2 PRIOR ART
FIG. 2 is a cross sectional view showing the center nut mistakenly brazed to the pad cup.
Figure 3:
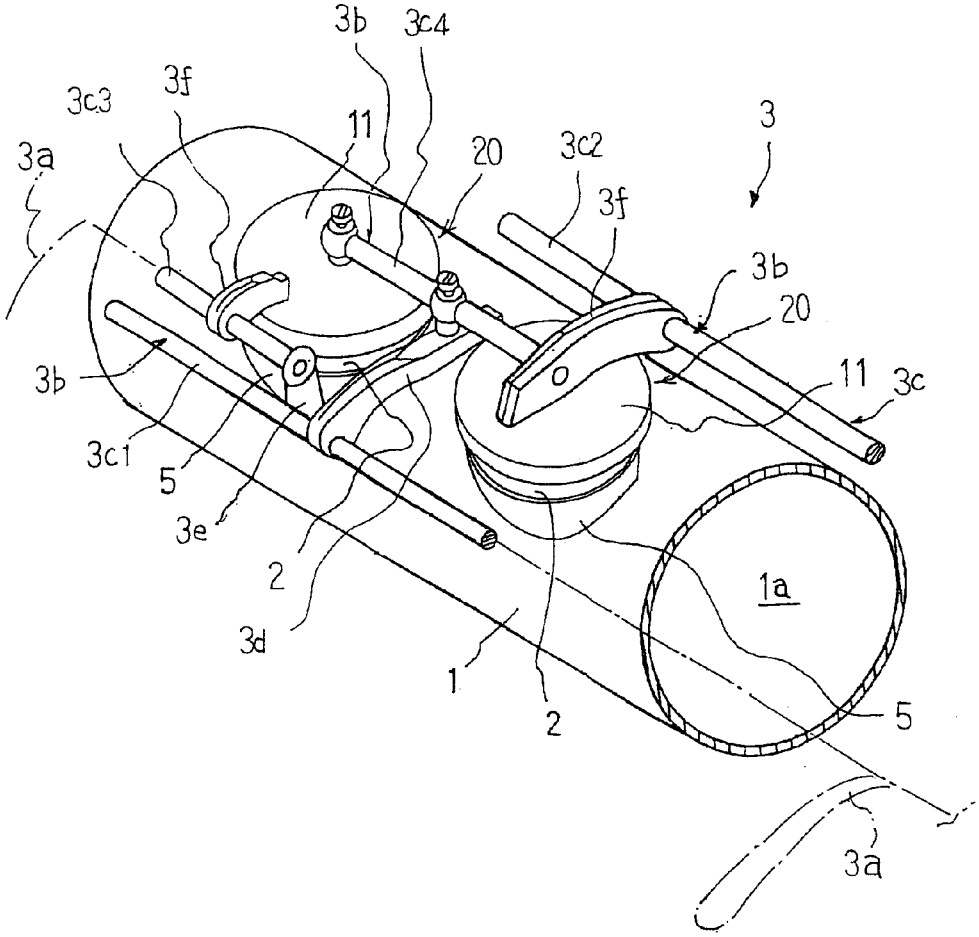
FIG. 3 is a perspective view showing the arrangement of a part of key mechanism incorporated in a flute.

Referring to FIG. 3 of the drawings, a flute embodying the present invention comprises a tube 1 and a key mechanism 3. An inner space 1*a* is defined in the tube 1, and the tube 1 is formed with a mouthpiece (not shown) and holes 2. The mouthpiece is open to the atmosphere at one end portion of the tube 1, and the holes 2 are arranged toward the end portion. In the following description, term "upstream" is indicative of a position key to the mouthpiece than a position modified with term "downstream". Namely, the holes 2 are arranged from the upstream side toward the downstream side along the tube 1. The inner space 1*a* is open to the atmosphere at the other end thereof, and is connected through the holes 2 to the atmosphere. The hole at the other end of the tube 1 is hereinbelow referred to as "end hole" in order to discriminate it from the holes 2.

The key mechanism 3 is provided on the tube 1, and a player selectively opens and closes the holes 2 by manipulating the key mechanism. The holes 2 are assigned to the notes of a scale, respectively, and the length of the air column is defined by the end hole or an open hole 2 closest to the mouthpiece. Thus, the player selectively changes the pitch of tones by means of the key mechanism 3.

The key mechanism 3 includes plural levers 3*a,* transmission devices 3*b* and keys 20. In this instance, the plural levers 3*a* and transmission devices 3*b* as a whole constitute a linkage. Key rods 3*c* such as 3*c*1/3*c*2/3*c*3/3*c*4, arms 3*d*/3*f* and key posts 3*e* are assembled into the transmission devices 3*b*. The key posts 3*e* are fixed to the outer surface of the tube 1, and the key rods 3*c* such as 3*c*1/3*c*3 are rotatably supported by the associated key posts 3*e*. The levers 3*a* are connected to selected ones of the key rods 3*c,* and return springs (not shown) always urge the key rods 3*c* to rotate in certain directions.

The keys 20 are selectively fixed to the key rods 3*c* by means of the arms 3*f,* and are associated with the holes 2, respectively. Tone hole chimneys 5 are fixed to the outer surface of the tube 1 in such a manner as to encircle the holes 2. The tone hole chimneys 5 form parts of the tube 1. Although the return springs (not shown) urge the key rods 3*c* to keep the keys 20 spaced from the tone hole chimneys 5, a player brings the keys 20 into contact with the upper peripheral edges of the tone hole chimneys 5 by exerting force on the levers 3*a* or directly on the keys 20 with his or her thumb and fingers.

Some key rods 3*c* are in a master-slave relation. Although these key rods 3*c* are coupled to the associated key rods 3*c,* the rotation is transmitted only from the master key rods 3*c,* which are driven for rotation by a player, to the slave key rods, but is not transmitted vise versa. The arms 3*d* are fixed to the certain key rods 3*c,* and are connected to other key rods 3*c* at the other ends thereof. The arms 3*d* transmit torque from the certain key rods 3*c* to the other key rods 3*c* so that the player can concurrently actuate plural transmission devices 3*b* by manipulating only one lever 3*a*. The master-slave key rods 3*c* and arms 3*d* permit a player sequentially to space the keys 20 from the holes 2 so as stepwise to change the pitch of the tones.

While a player is performing a piece of music on the flute, he or she breathes the air into the mouthpiece, and gives rise to vibrations of air column. The player tongues, and selectively opens and closes the holes 2 through the key mechanism 3. The vibrating air column is shortened and lengthened in response to the fingering on the key mechanism 3, and, accordingly, the pitch of tones is changed.

Figure 4:
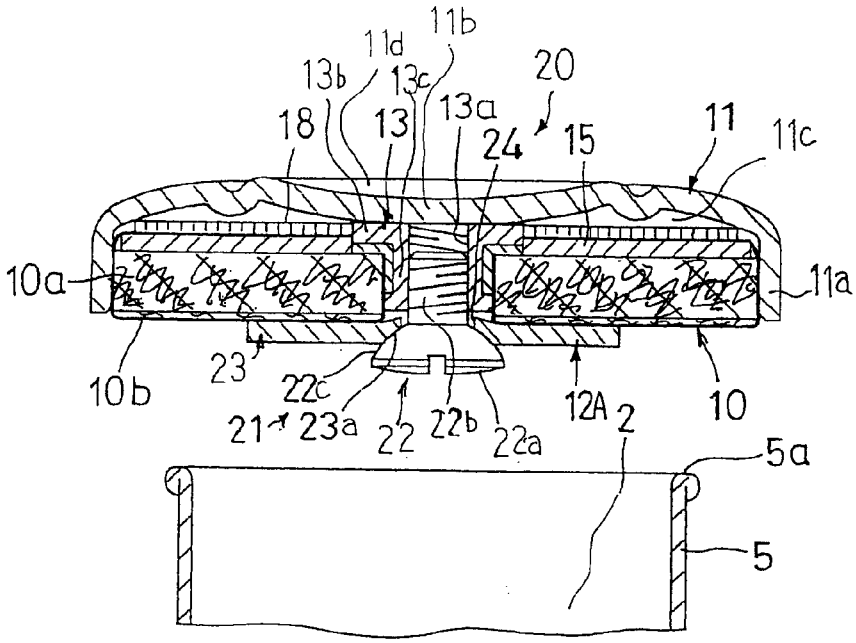
FIG. 4 is a cross sectional view showing the structure of a key incorporated in the flute.

FIG. 4 illustrates one of the keys 20 incorporated in the key mechanism 3. The key 20 is of the type directly depressed by a player. The key 20 includes a pad cup 11, a pad 10, a fastener 12A and an automatic regulator 21. Thus, the automatic regulator 21 is newly incorporated in the key 20. The pad 10 is fastened to the pad cup 11 by means of the fastener 12A. The automatic regulator 20 is provided between the fastener 12A and the pad 10, and makes the fastener 12A uniformly depress the pad 10 to the pad cup 11 regardless of the attitude of the fastener 12A.

The pad cup 11 is formed from a sheet of metal or alloy through a drawing. The pad cup 11 has a peripheral portion 11*a* and a central portion 11*b*. The peripheral portion 11*a* is curved from the central portion 11*b* so that the inner surface defines a recess 1*c*. The pad 10 and fastener 12 are provided in the recess 11*c*. The central portion 11*b* further defines a shallow dent 11*a* in the outer surface, and the player puts his or her finger in the dent 11*d* during the performance.

The pad 10 is also broken down into a core 10*a*/15 and a sealing layer 10*b*. The core 10*a*/15 imparts the adaptability to the pad 10, and the sealing layer 10*b* makes the pad 10 airtight. A core layer 10*a* and a backing cardboard 15 as a whole constitute the core. The backing cardboard 15 is made of paper, and the core layer 10*a* is made of air-permeable material such as, for example, compression felt. The core layer 10*a* is laminated on the backing cardboard 15, and sealing layer 10*b* is fixed to the core layer 10*a* reverse to the backing cardboard 15. The sealing layer 10*b* is expected to hermetically seal the air column inside the tube 1. Skin and bladder are available for the sealing layer 10*b*. It is preferable to make the sealing layer 10*b* from sheepskin, calfskin and bladder of sheep and calf. The pad 10 is formed with a center hole. The center hole is wider in the backing cardboards 15 than in the core/sealing layers 10*a*/10*b*.

The fastener 12A consists of a center nut 13, a bolt 22 and a pad washer 23. The center nut 13 is brazed to the inner surface of the pad cup 11, and an internal thread 13*a* is formed in the center nut 13 along the centerline thereof. The center nut 13 has a boss portion 13*b* and an end portion 13*c*. The boss portion 13*b* is held in contact with the inner surface of the central portion 11*b,* and is brazed thereto. The end portion 13*c* projects from the boss portion 13*b,* and the height of the center nut 13 is not greater than the depth of the recess 11*c*. The boss portion 13*b* is approximately equal in diameter to the hole formed in the backing cardboard 15, and the end portion 13*c* is approximately equal in diameter to the core/sealing layer 10*a*/10*b*. When the central column 13 is inserted into the center hole of the pad 10, the step at the boundary between the boss portion 13*b* and the end portion 13*c* is brought into face-to-face contact with the step at the boundary between the backing cardboard 15 and the core/sealing layers 10*a*/10*b* so as to keep the pad 10 substantially perpendicular to the centerline of the center nut 13. In this instance, the thickness of the pad 10 is less than the depth of the recess 11*c,* and a liner 18 is inserted between the pad 10 and the inner surface of the pad cup 11.

The bolt 22 is broken down into a head portion 22*a* and a threaded stem portion 22*b*. The bolt thread on the threaded stem portion 22*b* is corresponding to the inner thread 13*a,* and the bolt thread and the inner thread 13*a* are brought into threaded engagement with one another. The head portion 22*a* is different from the head portion of the bolt 14*a*. Although the reverse surface of the head portion 14*a* is flat, the head portion 22*a* has a convex surface 22*c*. In this instance, the convex surface forms a part of sphere so that the convex surface 22*c* is a semi-spherical surface 22*c*.

The pad washer 23 has a disc shape, and is made of metal or alloy. The pad washer 23 has the outer diameter less than the outer diameter of the pad 10. When the pad washer 23 is put on the pad 10, the periphery of the pad washer 23 is spaced from the peripheral portion 11*a* of the pad cup 11.

The pad washer 23 is also different from the pad washer 12*a*. The pad washer 12*a* has the flat major surfaces. On the other hand, the pad washer 23 has a concave surface or a curved surface 23*a,* which defines a semi-spherical recess. The curved surface 23*a* forms a part of the sphere. The curved surface 23*a* is corresponding to the semi-spherical surface 22*c* of the head portion 22*a*. The pad washer 23 is formed with a hole 24, and the hole 24 is greater in diameter than the threaded stem portion 22*b*. For this reason, the threaded stem portion 22*b* loosely passes through the hole 24.

The curved surface 23*a* is formed by pressing a steel ball against the inner peripheral area around the hole 24, and a part of the outer surface of the steel ball is identical with the semi-spherical surface 22*c*. The curved surface 23*a* and the semi-spherical surface 22*c* have a radius of curvature ranging between 1 millimeter to 10 millimeters. It is more preferable that the radius of curvature is fallen within the range between 1.5 millimeters to 5 millimeters. The semi-spherical surface 22*c* and the curved surface 23*a* as a whole constitute the automatic regulator 21. Thus, the automatic regulator 21 is associated with the fastener 12A.

The pad cup 11, pad 10, fastener 12A and automatic regulator 21 are assembled into the key 20 as follows. First, the pad cup 11 is assumed to have been correctly brazed to the arm 3*f*. Namely, the centerline of the center nut 13 is normal to the pad 10 and pad cup 11, and is in parallel to the centerline of the tone hole chimney 5. An assembling worker inserts the center nut 13 into the hole of the liner 18 and the center hole of the pad 10 so as to laminate the linear 18 and pad 10 on the inner surface of the pad cup 11. The assembling worker puts the pad washer 23 on the pad 10, and aligns the hole 24 with the hole in the center nut 13. The pad washer 23 takes the appropriate attitude, i.e., in parallel to the pad 10.

The bolt 22 is screwed into the center nut 13. The semi-spherical surface 22*c* is brought into contact with the curved surface 23*a,* and presses the pad washer 23 to the pad 10. Since the pad cup 11 has been correctly brazed to the arm 3*f,* the semi-spherical surface 22*c* imparts the pressure uniformly to the pad washer 23 over the contact area in the curved surface 23*a,* and the pad washer 23 presses the pad 10 and liner 18 against the pad cup 11 without changing the initial attitude. Thus, the automatic regulator 21 keeps the pad washer 23 in the initial appropriate attitude in so far as the pad cup 11 was correctly brazed to the arm 3*f*.

Figure 5:
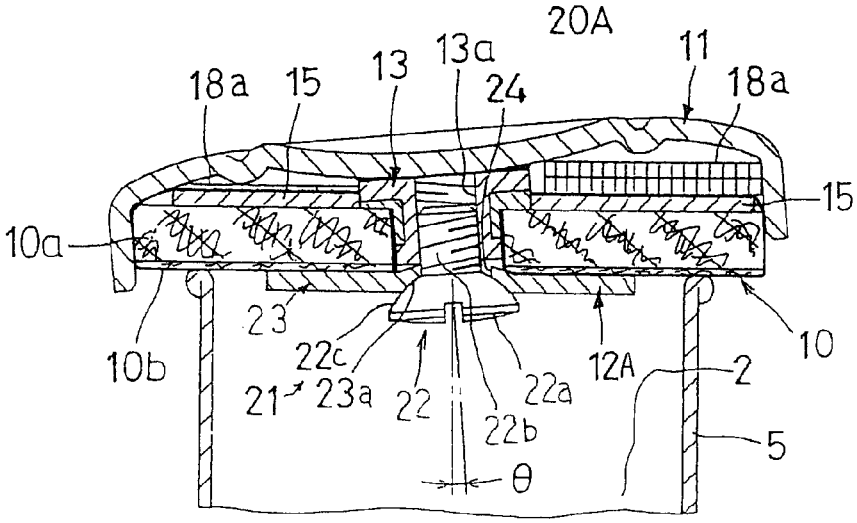
FIG. 5 is a cross sectional view showing a pad washer regulated to be parallel to a pad by means of an automatic regulator.

If the pad cup 11 was mistakenly brazed to the arm 3*f,* the centerline of the column 13 is inclined with respect to the centerline of the tone hole chimney 5 as shown in FIG. 5. The assembling worker inserts a adjusting shim 18*a* between the pad 10 and the inner surface of the pad cup 11, and makes the pad 10 perpendicular to the centerline of the tone hole chimney 5. The assembling worker puts the pad washer 23 on the pad 10, and aligns the hole 24 with the center hole of the pad 10. The pad washer 23 takes the attitude parallel to the pad 10.

The assembling worker screws the bolt 22 into the center nut 13. The bolt head 22*a* proceeds toward the pad washer 23 along the inclined centerline of the center nut 13. The semi-spherical surface 22*c* is brought into contact with the entire curved surface 23*a*. This is because of the fact that the semi-spherical surface 22*c* has the radius of curvature equal to that of the curved surface 23*a*. The assembling worker further screws the bolt 22 into the center nut 13, and the semi-spherical surface 22*c* exerts the force to the entire curved surface 23*a* of the pad washer 23. The pad washer 23 does not change the initial attitude, and presses the pad 10 and adjusting shim 18*a* against the inner surface of the pad cup 11. Thus, the automatic regulator 21 causes the pad washer 23 to keep the initial attitude, and any dent does not take place in the pad 10. This means that the pad 10 is brought into contact with the entire rounded periphery 5*a* of the tone hole chimney 5. The key 20 surely confines the vibrating column of air in the tube 1, and the pitch, loudness and timbre do not fluctuate during the performance.

As will be appreciated from the foregoing description, the automatic regulator 21 according to the present invention is provided in association with the fastener 12A, and regulates the attitude of the pad washer 21 always to be in parallel to the pad 10 regardless of the connection between the pad cup 11 and the fastener 12A. The fastener 12A exerts force uniformly on the pad 10 so that any dent does not take place in the pad 10. Even if the center nut 13, i.e., the fastener 22 is inaccurately fixed to the pad cup 11, the automatic regulator 21 takes up the inaccuracy, and the fastener 12A can exerts the force uniformly on the pad 10 as if the fastener 22 has been accurately fixed to the pad cup 11. By virtue of the automatic regulator 21, the fastener 12A holds the exposed surface of the pad 10 flat, and the key 20 surely opens and closes the holes 2 in response to the fingering on the key mechanism 3 during the performance.

Although particular embodiments of the present invention have been shown and described, it will be apparent to those skilled in the art that various changes and modifications may be made without departing from the spirit and scope of the present invention.

For example, the center nut 13 may be integral with the pad cup 11.

Another automatic regulator may have a bolt formed with the curved surface 23*a* and a pad washer formed with the semi-spherical surface 22*c* around the bolt hole 24.

Yet another automatic regulator may have a bolt formed with either semi-spherical or curved surface 22*c*/23*a* and a pad washer formed with a ring. The ring is slidable on the semi-spherical surface 22*c* and the curved surface 23*c* so that the automatic regulator keeps the attitude of the pad washer substantially in parallel to the pad. The ring may be replaced with plural small semi-spherical projections. The small semi-spherical projections are also slidable on the semi-spherical surface 22*c* and curved surface 23*a*.

Still another automatic regulator may have a pad washer formed with either semi-spherical or curved surface 22*c*/23*a* and a bolt formed with a ring. The ring is slidable on the semi-spherical surface 22*c* and the curved surface 23*c* so that the automatic regulator keeps the attitude of the pad washer substantially in parallel to the pad. The ring may be replaced with plural small semi-spherical projections. The small semi-spherical projections are also slidable on the semi-spherical surface 22*c* and curved surface 23*a*.

What is claimed is:

1. A woodwind instrument for generating tones through a vibrating column of air, comprising:

a tube having an inner space where said vibrating column of air takes place and plural holes connecting said inner space to the atmosphere; and a key mechanism including a linkage fixed to said tube and plural keys supported by said linkage over said plural holes and changed between respective open positions at which said holes are opened and respective closing positions at which said holes are closed, each of said keys having a pad cup connected to said linkage and formed with a recess, a deformable pad received in said recess and held in contact with a periphery of said tube defining associated one of said holes at said closing position, a adjusting shim inserted between said pad cup and said deformable pad, if necessary, in order to cause said deformable pad to be held in contact with the entire periphery of said tube defining said associated one of said holes at said closing position, a fastener connected to said pad cup and exerting force on said deformable pad for pressing said deformable pad and said adjusting shim, if any, to said pad cup and an automatic regulator provided in association with said fastener and causing said force to be substantially uniform over a contact surface between said fastener and said deformable pad.

2. The woodwind instrument as set forth in claim 1, in which said fastener includes a column formed with an internal thread and connected to said pad cup in such a manner to project into said recess, a pad washer provided on said deformable pad and formed with a hole and a bolt having a head portion to be driven for rotation and a threaded stem portion loosely passing through said hole formed in said pad washer and held in threaded engagement with said internal thread so that said head portion is pressed to said pad washer.

3. The woodwind instrument as set forth in claim 2 in which said head portion and said pad washer respectively have a convex surface and a concave surface portion around said hole slidably in contact with said convex surface, and said convex surface and said concave surface portion as a whole constitute said automatic regulator.

4. The woodwind instrument as set forth in claim 3, in which said concave surface and said concave surface portion form parts of a sphere, respectively.

5. The woodwind instrument as set forth in claim 4, in which said sphere has a radius of curvature fallen within the range from 1 millimeter to 10 millimeters.

6. The woodwind instrument as set forth in claim 4, in which said sphere has a radius of curvature fallen within the range from 1.5 millimeters to 5 millimeters.

7. The woodwind instrument as set forth in claim 2, in which said column is integral with said pad cup.

8. The woodwind instrument as set forth in claim 2, in which said column is brazed to an inner surface of said pad cup.

9. The woodwind instrument as set forth in claim 1, in which said deformable pad has a core layer formed of deformable material and a protective layer laminated on said core layer, formed of airtight material and receiving said force exerted by said fastener.

10. The woodwind instrument as set forth in claim 9, in which said deformable material is compressed felt, and said airtight material is selected from the group consisting of skin and bladder.

11. The woodwind instrument as set forth in claim 9, in which said fastener includes a column formed with an internal thread and connected to said pad cup in such a manner to project into said recess, a pad washer provided on said protective layer and formed with a hole and a bolt having a head portion to be driven for rotation and a threaded stem portion loosely passing through said hole formed in said pad washer and held in threaded engagement with said internal thread so that said head portion is pressed to said pad washer.

12. The woodwind instrument as set forth in claim 11 in which said head portion and said pad washer respectively have a convex surface and a concave surface portion around said hole slidably in contact with said convex surface, and said convex surface and said concave surface portion as a whole constitute said automatic regulator.

13. The woodwind instrument as set forth in claim 12, in which said concave surface and said concave surface portion form parts of a sphere, respectively.

14. The woodwind instrument as set forth in claim 13, in which said sphere has a radius of curvature fallen within the range from 1 millimeter to 10 millimeters.

15. The woodwind instrument as set forth in claim 13, in which said sphere has a radius of curvature fallen within the range from 1.5 millimeters to 5 millimeters.

16. The woodwind instrument as set forth in claim 11, in which said column is integral with said pad cup.

17. The woodwind instrument as set forth in claim 11, in which said column is brazed to an inner surface of said pad cup.

* * * * *